US012129721B1

(12) United States Patent
Dyble et al.

(10) Patent No.: US 12,129,721 B1
(45) Date of Patent: Oct. 29, 2024

(54) SYSTEMS AND METHODS USING A COMPACT POWERED SUBSEA WINCH

(71) Applicant: Schlumberger Technology Corporation, Sugar Land, TX (US)

(72) Inventors: Alan Dyble, Singapore (SG); Charlotte Giraud, Tananger (NO); Cameron Berry, Portlethen (GB); Thomas William McIlroy, Portlethen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/683,903

(22) PCT Filed: Aug. 16, 2022

(86) PCT No.: PCT/US2022/040399
§ 371 (c)(1),
(2) Date: Feb. 15, 2024

(87) PCT Pub. No.: WO2023/023010
PCT Pub. Date: Feb. 23, 2023

Related U.S. Application Data

(60) Provisional application No. 63/233,428, filed on Aug. 16, 2021.

(30) Foreign Application Priority Data

Aug. 16, 2021 (EP) ..... 21306122

(51) Int. Cl.
*E21B 19/22* (2006.01)
*E21B 33/076* (2006.01)

(52) U.S. Cl.
CPC ..... *E21B 19/22* (2013.01); *E21B 33/076* (2013.01)

(58) Field of Classification Search
CPC ..... E21B 19/22; E21B 33/076
See application file for complete search history.

(56) References Cited

U.S. PATENT DOCUMENTS 3,920,076 A * 11/1975 Laky ..... E21B 33/072 166/77.2
5,503,014 A * 4/1996 Griffith ..... E21B 17/203 166/311

(Continued)

FOREIGN PATENT DOCUMENTS

WO 02/20938 A1 3/2002
WO 2006/099316 A1 9/2006

OTHER PUBLICATIONS

PCT International Search Report and Written Opinion; Application No. PCT/US2022/040399; Dated Nov. 28, 2022; 9 pages.

(Continued)

*Primary Examiner* — Aaron L Lembo
(74) *Attorney, Agent, or Firm* — Jeffrey D. Frantz

(57) ABSTRACT

Systems and methods presented herein include a subsea hose deployment winch having a spool configured to receive a subsea hose spooled thereon; and a mechanical intervention device launcher assembly configured to be directly coupled to an end of the subsea hose. The mechanical intervention device launcher assembly may be configured to facilitate insertion of a mechanical intervention device into the subsea hose while maintaining an isolation barrier to the environment.

16 Claims, 12 Drawing Sheets

(56) References Cited

U.S. PATENT DOCUMENTS

| | | | | |
|---|---|---|---|---|
| 6,062,769 | A | 5/2000 | Cunningham | |
| 6,712,150 | B1 * | 3/2004 | Misselbrook | E21B 17/203 166/387 |
| 7,225,877 | B2 * | 6/2007 | Yater | E21B 41/0007 166/344 |
| 9,103,183 | B2 | 8/2015 | He et al. | |
| 9,347,294 | B2 * | 5/2016 | Gramstad | E21B 19/002 |
| 9,476,269 | B2 * | 10/2016 | Dyck | B65H 75/4442 |
| 10,329,858 | B1 * | 6/2019 | He | E21B 19/22 |
| 10,385,641 | B2 * | 8/2019 | Carlsen | E21B 33/035 |
| 10,794,527 | B2 * | 10/2020 | Barmatov | F16L 58/1009 |
| 11,299,938 | B2 * | 4/2022 | Quero | E21B 17/041 |
| 2003/0155127 | A1 * | 8/2003 | Carlsen | E21B 19/002 166/344 |
| 2004/0094305 | A1 * | 5/2004 | Skjærseth | E21B 19/22 166/70 |
| 2006/0219412 | A1 | 10/2006 | Yater | |
| 2007/0029090 | A1 * | 2/2007 | Andreychuk | E21B 7/02 166/308.1 |
| 2008/0302535 | A1 * | 12/2008 | Barnes | E21B 17/01 166/339 |
| 2010/0038091 | A1 * | 2/2010 | Sack | E21B 43/01 166/345 |
| 2012/0247579 | A1 * | 10/2012 | Park | B65H 75/4478 137/355.26 |
| 2014/0290961 | A1 | 10/2014 | Gramstad | |

OTHER PUBLICATIONS

International Preliminary Report on Patentability of International Patent Application No. PCT/US2022/040599 dated Feb. 29, 2024, 6 pages.

* cited by examiner

SYSTEMS AND METHODS USING A COMPACT POWERED SUBSEA WINCH

CROSS-REFERENCE TO RELATED APPLICATION

The present document is a National Stage Entry of International Application No. PCT/US2022/040399, filed Aug. 16, 2022, which is based on and claims priority to U.S. Provisional Application Ser. No. 63/233,428, filed Aug. 16, 2021, and EP Patent Application No. 21306122.9, filed Aug. 16, 2021, each of which is incorporated herein by reference in its entirety.

BACKGROUND

The present disclosure generally relates to systems and methods for well intervention operations in subsea wells and, more particularly, to systems and methods for deploying a subsea well intervention system from a surface vessel using a compact powered subsea winch that incorporates a mechanical intervention device launcher assembly.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Well operations in shallow depth waters sometimes utilize a floating vessel having coiled tubing and various hydraulic hoses and electric cables. A catenary system creates slack in the coiled tubing or the hydraulic hose between a subsea tree and a reel mounted on the floating vessel. In certain situations, mechanical intervention devices may need to be introduced into an intervention flow path, which introduces additional operational considerations as well as increasing the cost of equipment to enable the use of such mechanical intervention devices.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a subsea hose deployment winch comprising a spool configured to have a subsea hose spooled thereon; and a mechanical intervention device launcher assembly which may be directly coupled to an end of the subsea hose. The mechanical intervention device launcher assembly is configured to facilitate insertion of a mechanical intervention device into the subsea hose. The mechanical intervention device launcher assembly also may be constructed to maintain an isolation barrier to the environment.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
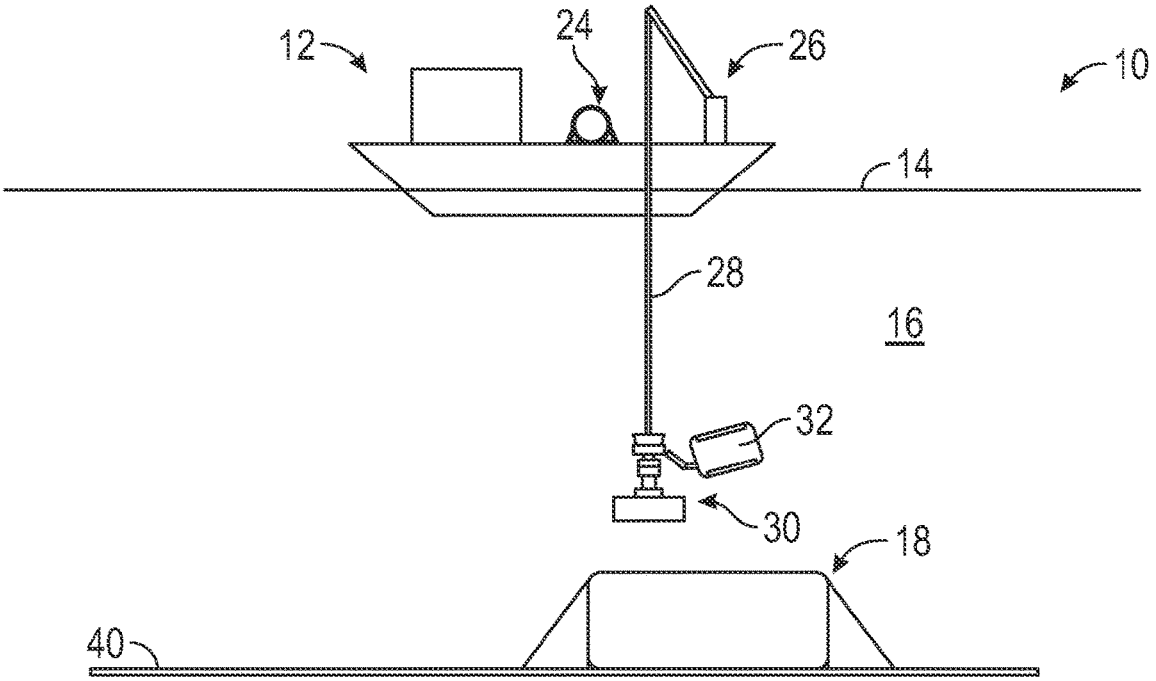
FIG. 1 illustrates an initial portion of a sequence regarding operation of a subsea well intervention system from a surface vessel floating at the surface of a body of water to a subsea tree, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upstream" and "downstream", "upper" and "lower," "top" and "bottom," and other like terms indicating relative positions to a given point or element are utilized to more clearly describe some elements. As used herein, the terms "elongate," "relatively elongate," "substantially elongate," and so forth, are used to mean an object that has a length-to-width ratio (e.g., a length-to-diameter ratio) greater than 3.0, greater than 3.5, greater than 4.0, greater than 4.5, greater than 5.0, or even greater.

The embodiments described herein generally include systems and methods for deploying a subsea well intervention system from a surface vessel using a compact powered subsea winch that incorporates a mechanical intervention device launcher assembly. The embodiments described herein are designed to facilitate subsea hydraulic intervention operations that use mechanical intervention devices (e.g., cylindrical mechanical intervention devices, such as cylindrical mechanical intervention darts) that are introduced into the intervention flow path. In particular, the embodiments described herein enable the deployment of an intervention hose with, for example, pre-installed buoyancy modules, bend stiffeners, and a subsea connector while providing a safe, convenient, and efficient means of introducing mechanical intervention devices into the intervention flow path. As described in greater detail herein, the hose may be combined with pre-installed buoyancy modules and bend stiffeners for reasons including: (1) to maintain a minimum bend radius of the hose required to pump the mechanical intervention devices that aim for zonal isolation between the stimulation stages, and (2) to eliminate the need for a heave-compensated winch on the vessel by manipulating the hose into a "lazy-s" form which decouples vessel movements from wellhead loading.

The mechanical intervention device launcher assembly described herein enables convenient placement and launching of multiple mechanical intervention devices into the intervention flow path without the need to disconnect the system from the subsea tree. In addition, the mechanical intervention device launcher described herein may be constructed to ensure that two isolation barriers to the environment are maintained throughout the mechanical intervention device loading process. In addition, embodiments described herein may incorporate an emergency disconnect mechanism which may comprise a passive weak link system for emergency situations such as vessel drive-off or drift-off.

FIGS. 1 through 7 illustrate an operational sequence example employed with respect to a subsea well intervention system 10 from a surface vessel 12 floating at the surface 14 of a body of water 16 to a subsea tree 18. As illustrated, the subsea well intervention system 10 includes a hose 20 that incorporates buoyancy modules 22 (see FIG. 2) to facilitate continuous buoyancy of the hose 20. In certain embodiments, the hose 20 is made of a continuous flexible pipe such as coiled tubing. In the illustrated embodiment, the vessel 12 may comprise two handling devices including: a compact powered subsea winch 24 and a crane 26. However, in other embodiments, the crane 26 may be located separately from the vessel 12, for example, as part of a separate inspection, maintenance, repair (IMR) vessel. The winch 24 may be electrically powered, hydraulically powered, or otherwise suitably powered. In other words, the winch 24 may include a variety of spools which are electrically, hydraulically, or otherwise suitably powered for unspooling and spooling hose 20. An example of a spool is described in greater detail below.

In certain embodiments, the subsea well intervention system 10 may be specifically designed for use in relatively shallow bodies of water 16 having a depth, for example, of between 100 feet and 500 feet, between 150 feet and 400 feet, between 200 feet and 300 feet, or approximately 250 feet. As such, the hose 20 may have a total length of between 200 feet and 600 feet, between 250 feet and 550 feet, between 300 feet and 500 feet, or approximately 400 feet. However, these dimensions are merely provided as examples to illustrate the relative sizes of operation of the subsea well intervention system 10 described herein, and are not intended to be limiting.

Figure 2:
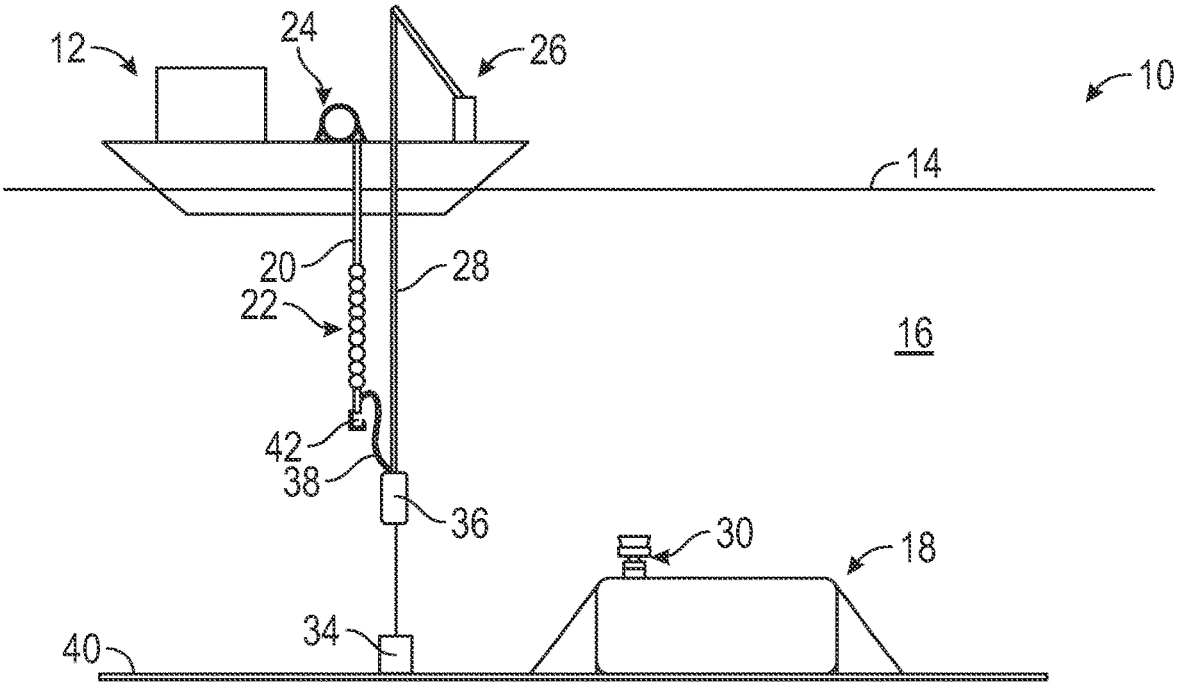
FIG. 2 illustrates a subsequent portion of the sequence regarding operation of the subsea well intervention system from the surface vessel, in accordance with embodiments of the present disclosure.
Figure 3:
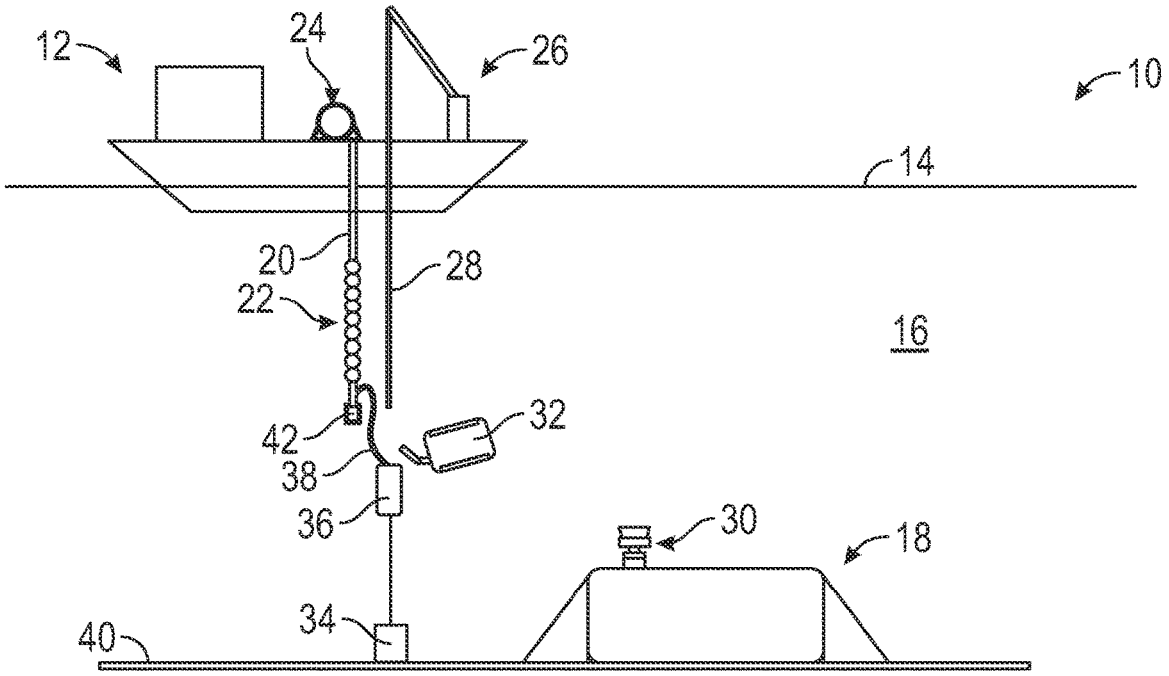
FIG. 3 illustrates a subsequent portion of the sequence regarding operation of the subsea well intervention system from the surface vessel, in accordance with embodiments of the present disclosure.
Figure 4:
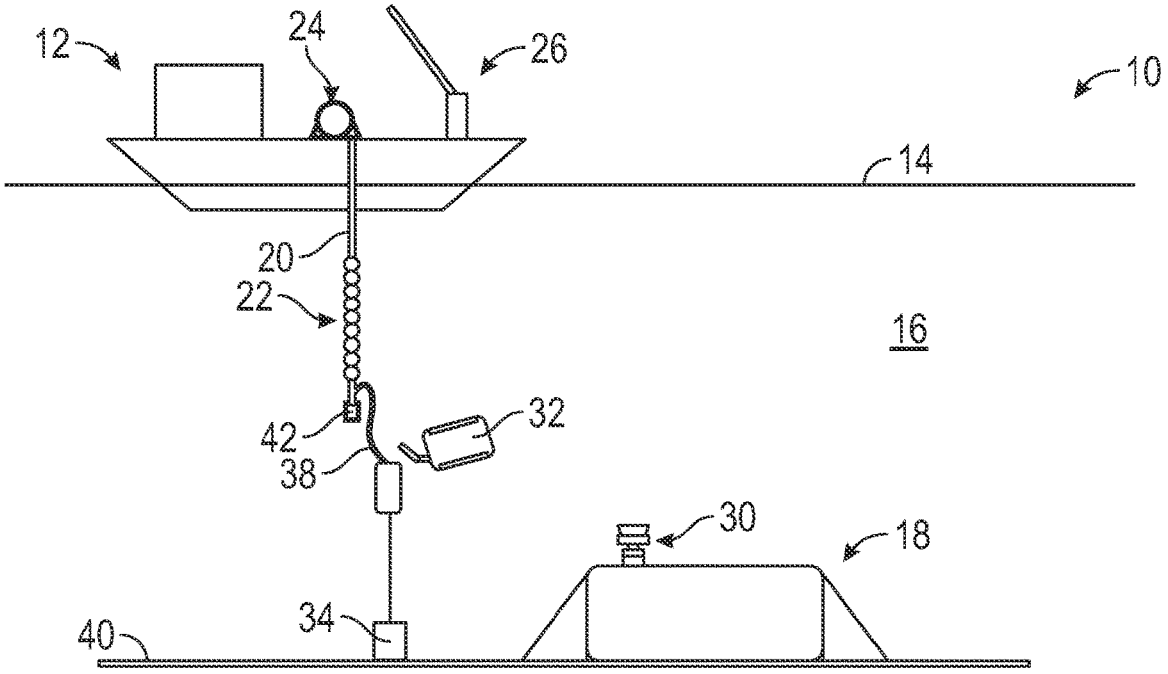
FIG. 4 illustrates a subsequent portion of the sequence regarding operation of the subsea well intervention system from the surface vessel, in accordance with embodiments of the present disclosure.
Figure 5:
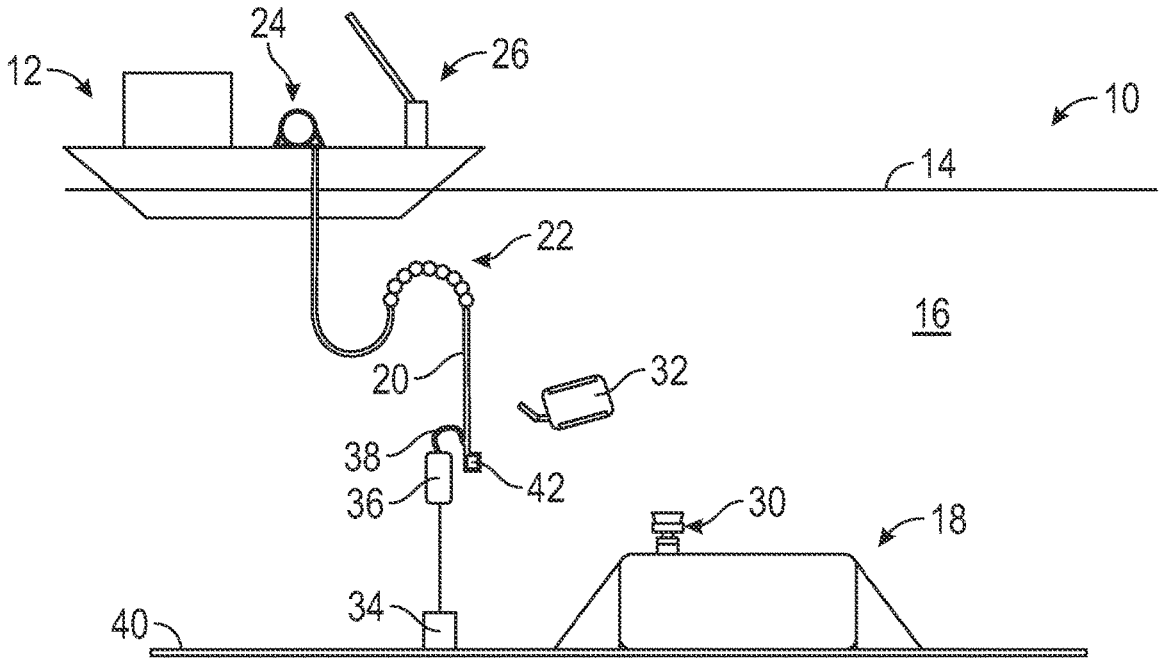
FIG. 5 illustrates a subsequent portion of the sequence regarding operation of the subsea well intervention system from the surface vessel, in accordance with embodiments of the present disclosure.
Figure 6:
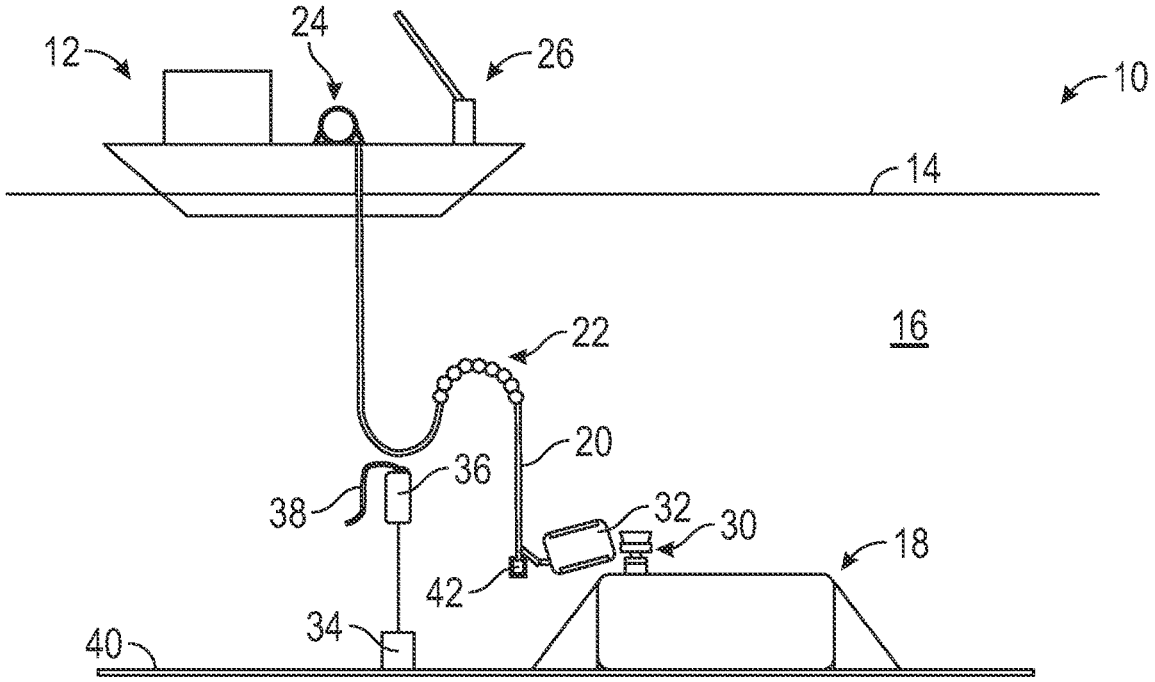
FIG. 6 illustrates a subsequent portion of the sequence regarding operation of the subsea well intervention system from the surface vessel, in accordance with embodiments of the present disclosure.
Figure 7:
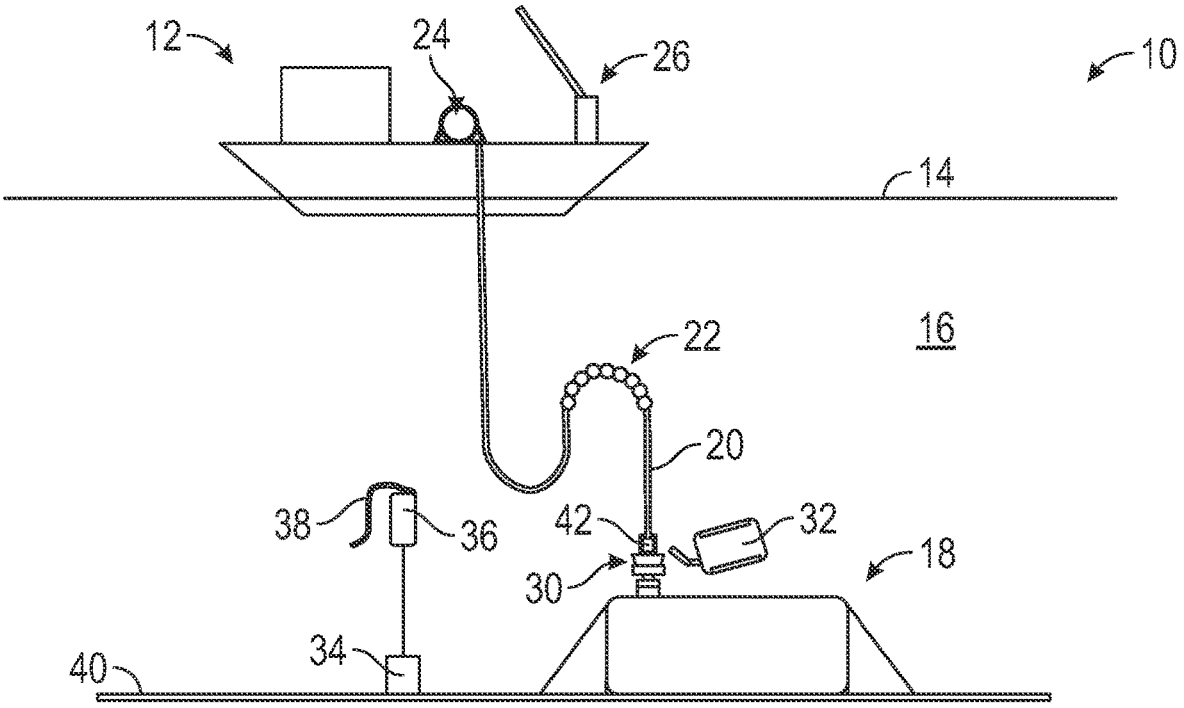
FIG. 7 illustrates a subsequent portion of the sequence regarding operation of the subsea well intervention system from the surface vessel, in accordance with embodiments of the present disclosure.

As illustrated in FIG. 1, a crane line 28 deployed by the crane 26 may open the subsea tree 18 and install a fluid injection assembly 30 (e.g., a "stim cap") on the subsea tree 18 with the assistance of a remotely operated vehicle (ROV) 32. Then, as illustrated in FIG. 2, the vessel 12 is repositioned with respect to (e.g., generally above) the subsea tree 18, and the crane line 28 deploys a clump weight 34 and a buoyancy device 36 which are attached to the hose 20 via a tether 38. At this time, the hose 20 is unspooled from the winch 24 until the clump weight 34 lands on the seabed 40. Enough hose 20 is paid out to eliminate snagging. Then, as illustrated in FIG. 3, the ROV 32 disconnects the crane line 28 from the buoyancy device 36 and the clump weight 34. Subsequently, as illustrated in FIG. 4, the crane line 28 is returned to the surface. Then, as illustrated in FIG. 5, the hose 20 is further unspooled from the winch 24 to allow, for example, a catenary to form in the hose 20. Then, as illustrated in FIG. 6, the ROV 32 disconnects the tether 38 from the hose 20, attaches to an ROV hook 42 connected to the hose 20, and pulls the hose 20 into position. As further illustrated in FIG. 7, the ROV 32 then establishes a connection between the hose 20 and the fluid injection assembly 30 and, thus, the subsea tree 18.

Once the hose 20 is connected to the fluid injection assembly 30 and the subsea tree 18 (e.g., once the hose 20 has been fully unspooled from the winch 24), one or more mechanical intervention devices may be introduced into an intervention flow path via the hose 20 for the purpose of, for example, opening fracturing sleeves. Examples of mechanical intervention devices may include balls, plugs, darts, and so forth. In certain embodiments, the mechanical intervention devices may be electrically connected back to the surface (e.g., back to vessel 12). Depending on the well application, as many as 5, 10, 15, or even more mechanical intervention devices may be introduced into the intervention flow path for a given well.

Figure 8:
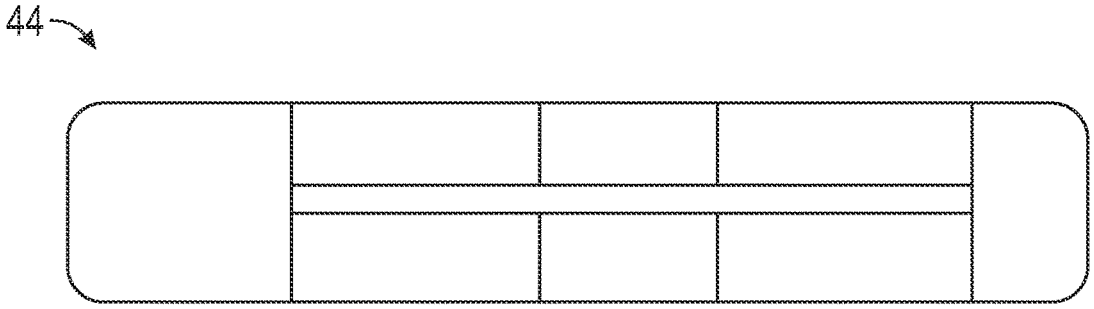
FIG. 8 illustrates an example of a mechanical intervention device, e.g. a dart, in accordance with embodiments of the present disclosure.

As described herein, the winch 24, the hose 20, the buoyancy modules 22, as well as the other components of the subsea well intervention system 10 enable the deployment of relatively elongate mechanical intervention devices, such as mechanical intervention darts. FIG. 8 illustrates an example of a mechanical intervention device 44. In this embodiment, mechanical intervention device 44 is in the shape of a mechanical intervention dart. The mechanical intervention dart 44 (or other type of mechanical intervention device) may be deployed into an intervention flow path, as described in greater detail below. As illustrated in FIG. 8, the mechanical intervention dart 44 may include a length-to-diameter ratio of approximately 5.0. However, in other embodiments, the mechanical intervention device, e.g. dart, 44 may have other relatively elongate shapes with other length-to-diameter ratios. Depending on parameters of a specific application, various other types of elongate, cylindrical mechanical intervention devices 44 may be deployed into an intervention flow path via the hose 20.

In certain embodiments, the elongate, cylindrical mechanical intervention devices 44 may have outer diameters of between 2.0 inches and 5.0 inches, between 2.5 inches and 4.5 inches, between 3.0 inches and 4.0 inches, or approximately 3.5 inches; lengths of between 8.0 inches and 16.0 inches, between 9.0 inches and 15.0 inches, between 10.0 inches and 14.0 inches, between 11.0 inches and 13.0 inches, or approximately 12.0 inches. As such, minimum bending radii of the hose 20 to facilitate the introduction of the elongate, cylindrical mechanical intervention devices 44 into an intervention path may, for example, be between 100 inches and 160 inches, between 110 inches and 150 inches, between 120 inches and 140 inches, or approximately 130 inches. However, these dimensions of the elongate, cylindrical mechanical intervention devices 44 and minimum bending radii are provided merely as examples to illustrate approximate sizes of the elongate, cylindrical mechanical intervention devices 44 suitable for various well applications and are not intended to be limiting.

As will be appreciated, movement of elongate, cylindrical mechanical intervention devices 44 to an intervention flow path via the hose 20 benefits from a controlled longitudinal shape of hose 20. Accordingly, the buoyancy modules 22 may be configured to provide not only buoyancy for the hose 20, as described with reference to FIGS. 1 through 7, but also bending restriction for the hose 20 to ensure that the hose maintains a minimum bending radius selected to facilitate movement of the elongate, cylindrical mechanical intervention devices 44 as they are routed through the hose 20. As such, the buoyancy modules 22 may also function as bend restrictors (e.g., bend stiffeners) to both support the hose 20 as well as limit over-bending of the hose 20. In certain embodiments, between 10 and 18 buoyancy modules 22, between 11 and 17 buoyancy modules 22, between 12 and 16 buoyancy modules 22, between 13 and 15 buoyancy modules 22, or 14 buoyancy modules 22 may be used. However, other numbers of buoyancy modules 22 may be used in other embodiments. In certain embodiments, a dedicated bend restrictor, e.g. a dedicated vertebrae-style bend restrictor, may be disposed at an end of the hose 20. Furthermore, the buoyancy modules 22 and the dedicated bend restrictor may be pre-installed around the hose 20 before the hose 20 is spooled onto the winch 24.

Figure 9:
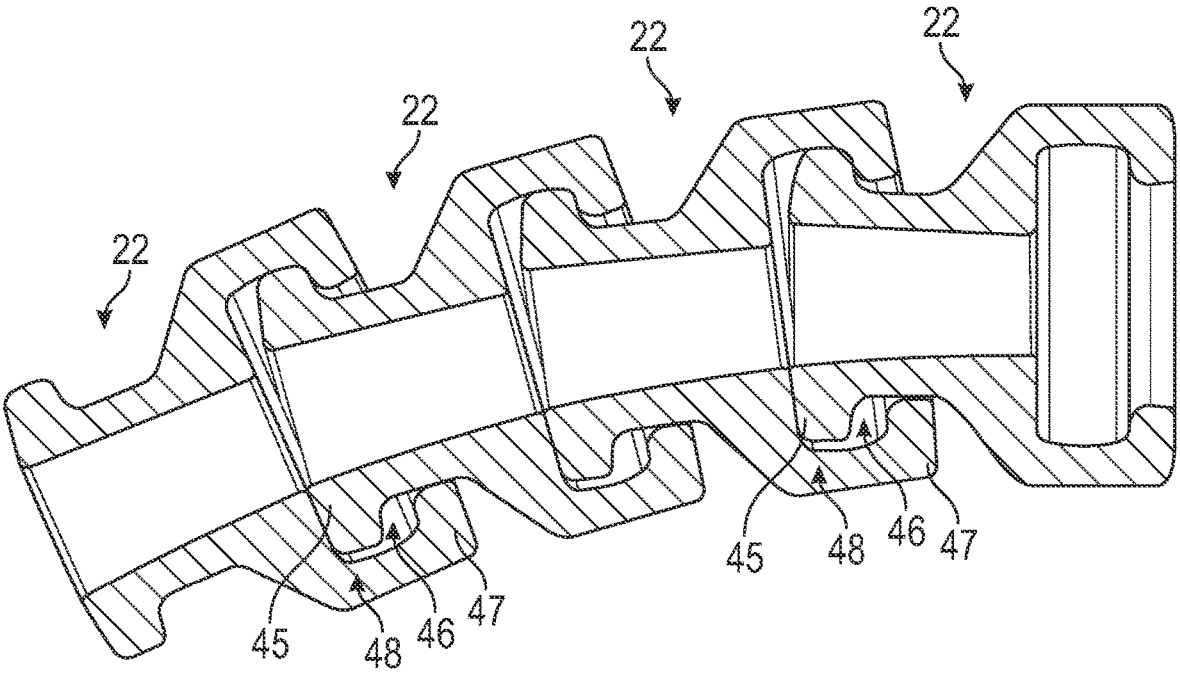
FIG. 9 illustrates a series of interconnected buoyancy modules, in accordance with embodiments of the present disclosure.

FIG. 9 illustrates a non-limiting example of a series of interconnected buoyancy modules 22. In this type of embodiment, first ends 45 of the buoyancy modules 22 may be configured to fit within internal volumes 46 defined at second ends 47 of adjacent buoyancy modules 22. The internal volumes 46 are shaped such that they limit the amount of movement of the first ends 45 of the buoyancy modules 22, thereby limiting bending of the buoyancy modules 22 and thus limiting bending of the hose 20 that the buoyancy modules 22 are disposed about. In other words, the cooperating internal volume 46 and ends 45, 47 serve as one type of bend restrictor 48, i.e. an integrated bend restrictor which combines both buoyancy and bend restriction.

Figure 10:
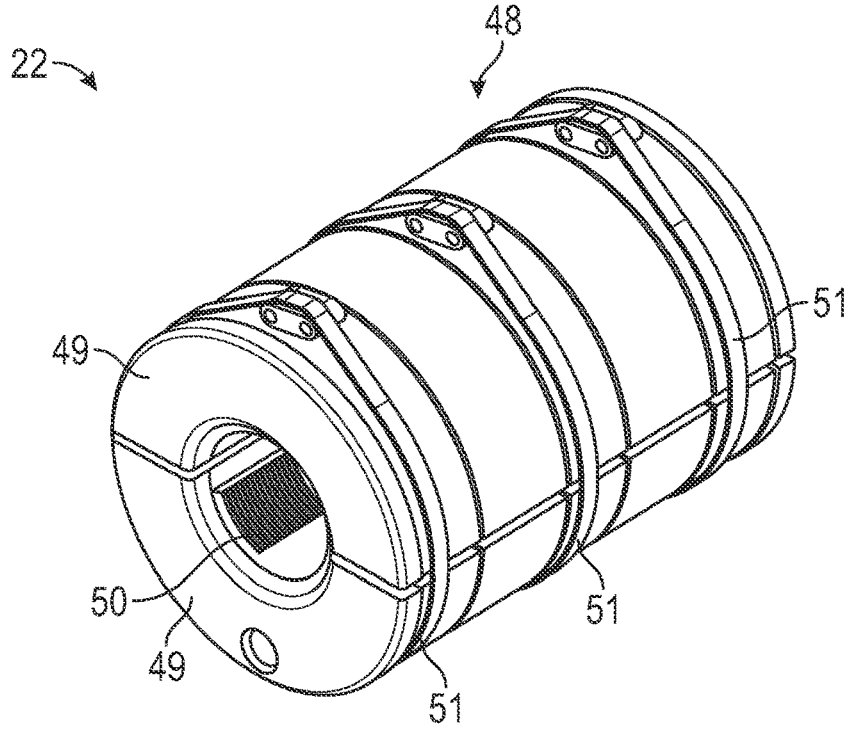
FIG. 10 illustrates an orthogonal view of a buoyancy module, in accordance with embodiments of the present disclosure.
Figure 11:
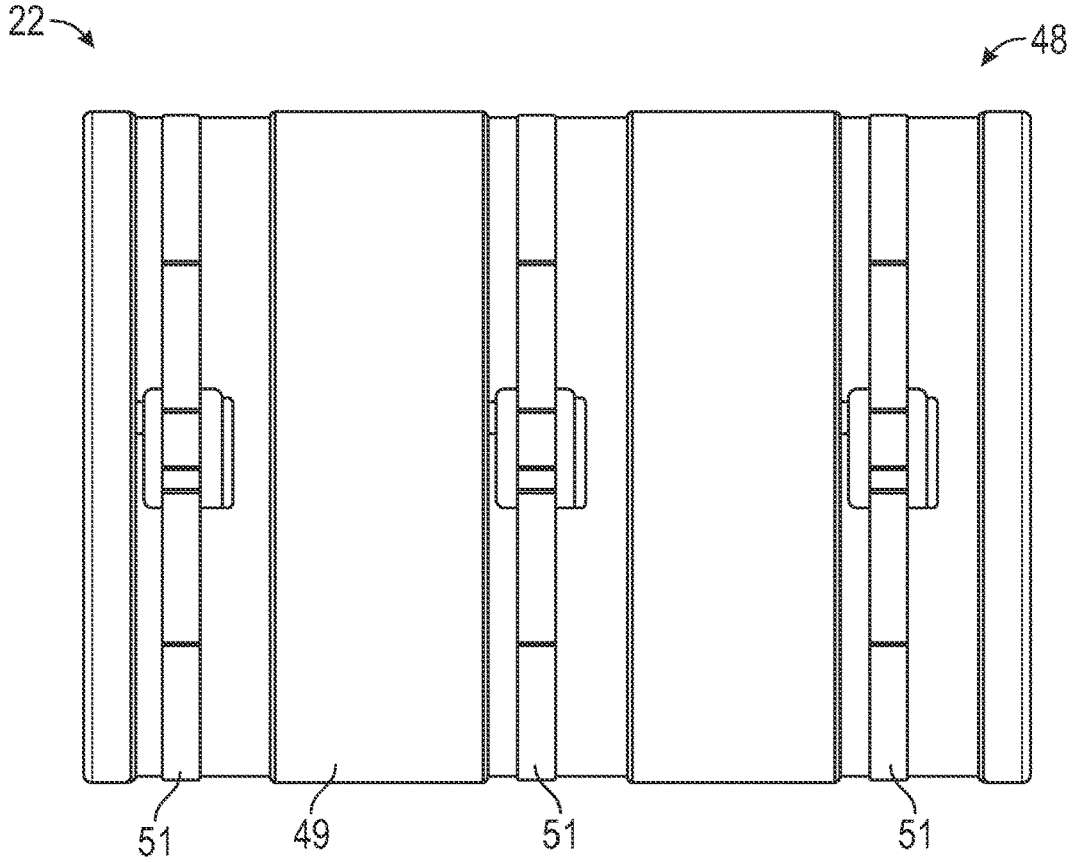
FIG. 11 illustrates a side view of the buoyancy module illustrated in FIG. 10, in accordance with embodiments of the present disclosure.

The embodiments of the buoyancy modules 22 illustrated in FIG. 9 are examples and are not intended to be limiting. For example, FIGS. 10 and 11 illustrate orthogonal and side views, respectively, of another example of a buoyancy module 22 and/or bend restrictor 48. By way of example, the device illustrated in FIGS. 10 and 11 may be formed of a buoyant material with sufficient rigidity to establish an integrated buoyancy module 22 and bend restrictor 48.

In this embodiment, the buoyancy module 22 and/or bend restrictor 48 comprises a pair of separable sections 49 which may be combined to create a longitudinal opening 50. The longitudinal opening 50 is sized to grip hose 20 when the separable sections 49 are assembled, i.e. closed, over the hose 20. The separable sections 49 may be held in the assembled/closed position by bands 51 or other suitable fasteners to securely affix the buoyancy module 22/bend restrictor 48 along hose 20. It should be noted two separable sections 49 are illustrated but a greater number of separable sections 49 may be employed when constructing each buoyancy module 22 and/or bend restrictor 48.

Figure 12:
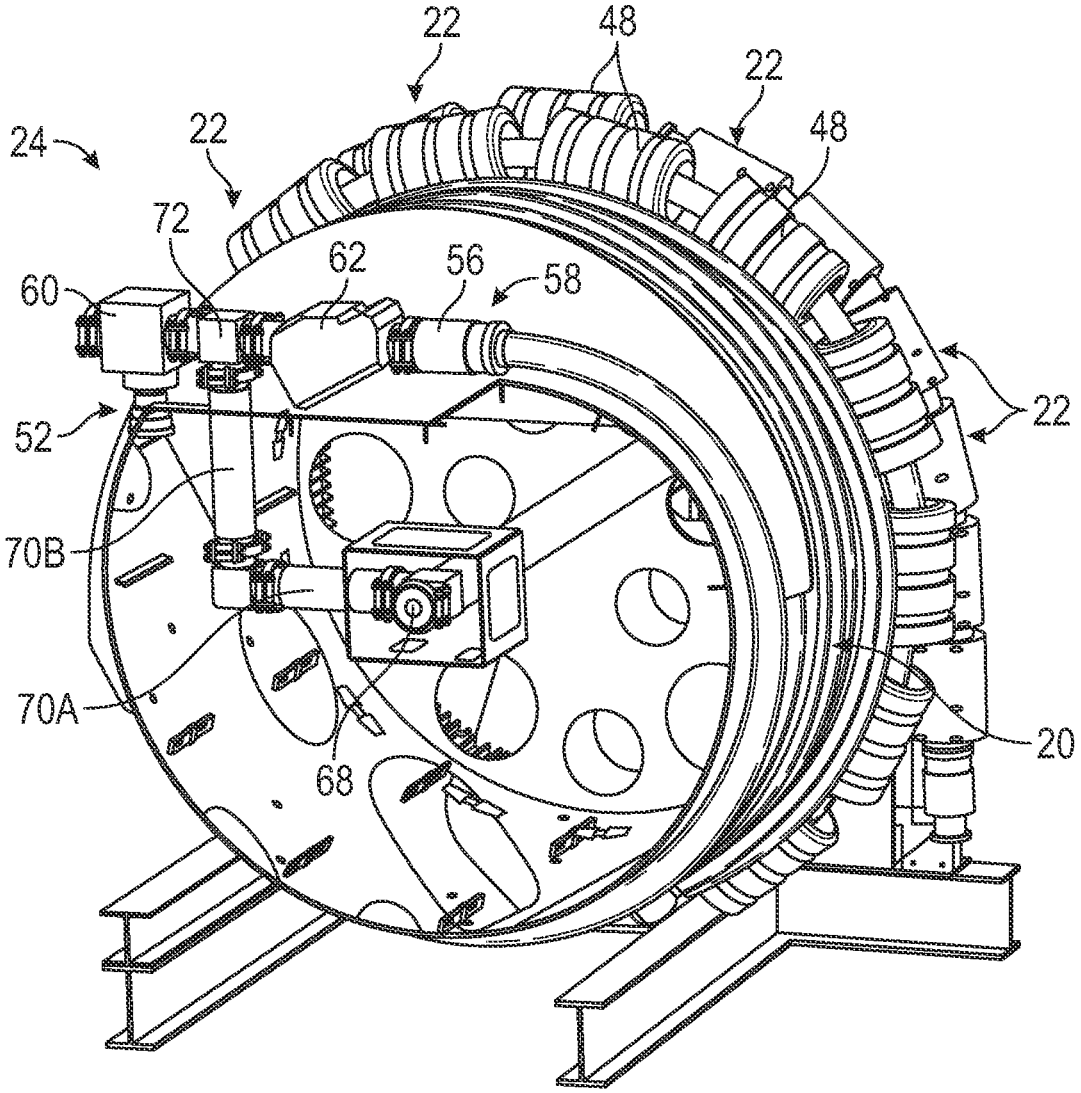
FIG. 12 illustrates a view of a winch that includes a mechanical intervention device launcher assembly, in accordance with embodiments of the present disclosure.
Figure 13:
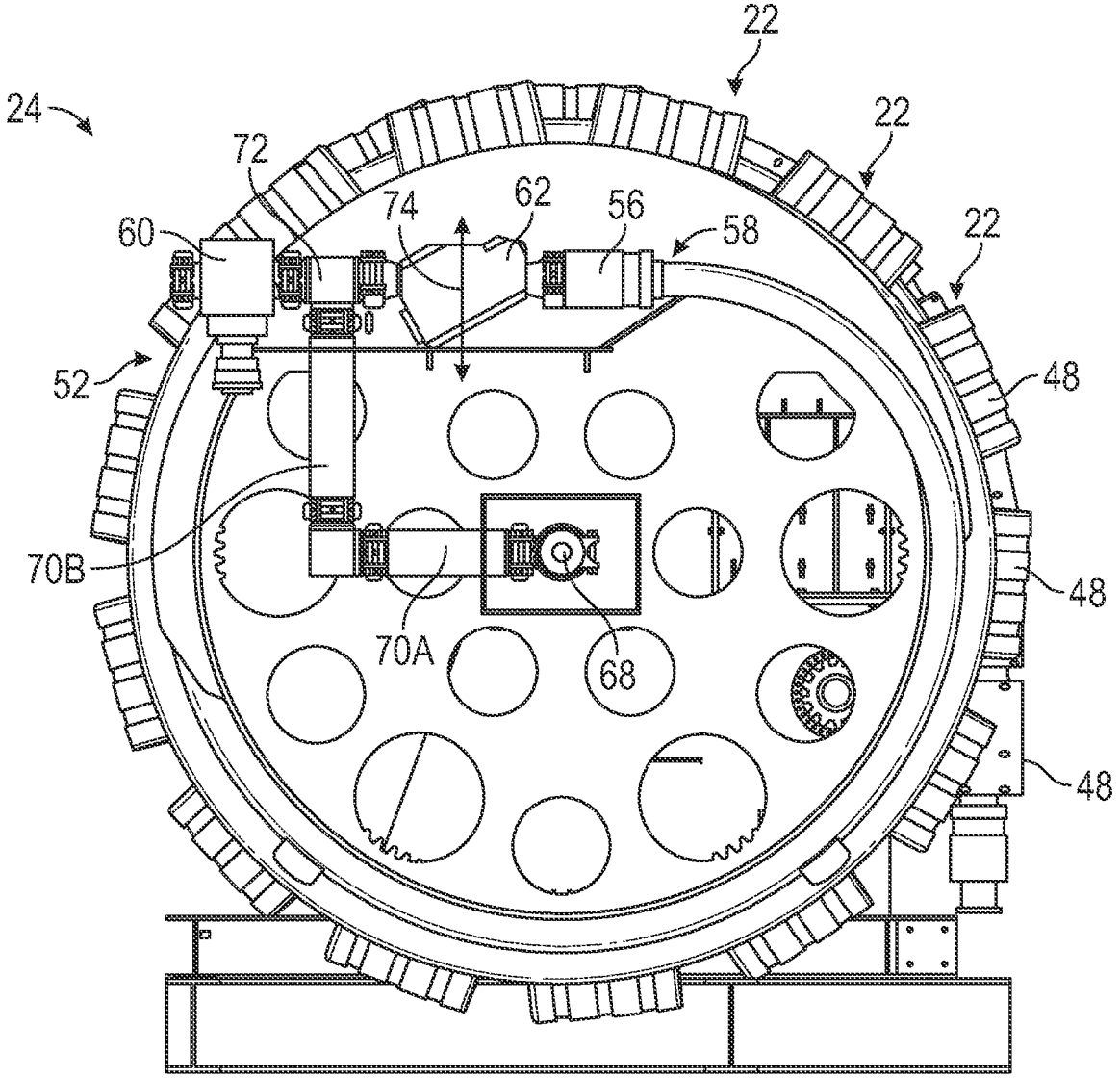
FIG. 13 illustrates another view of the winch including the mechanical intervention device launcher assembly, in accordance with embodiments of the present disclosure.
Figure 14:
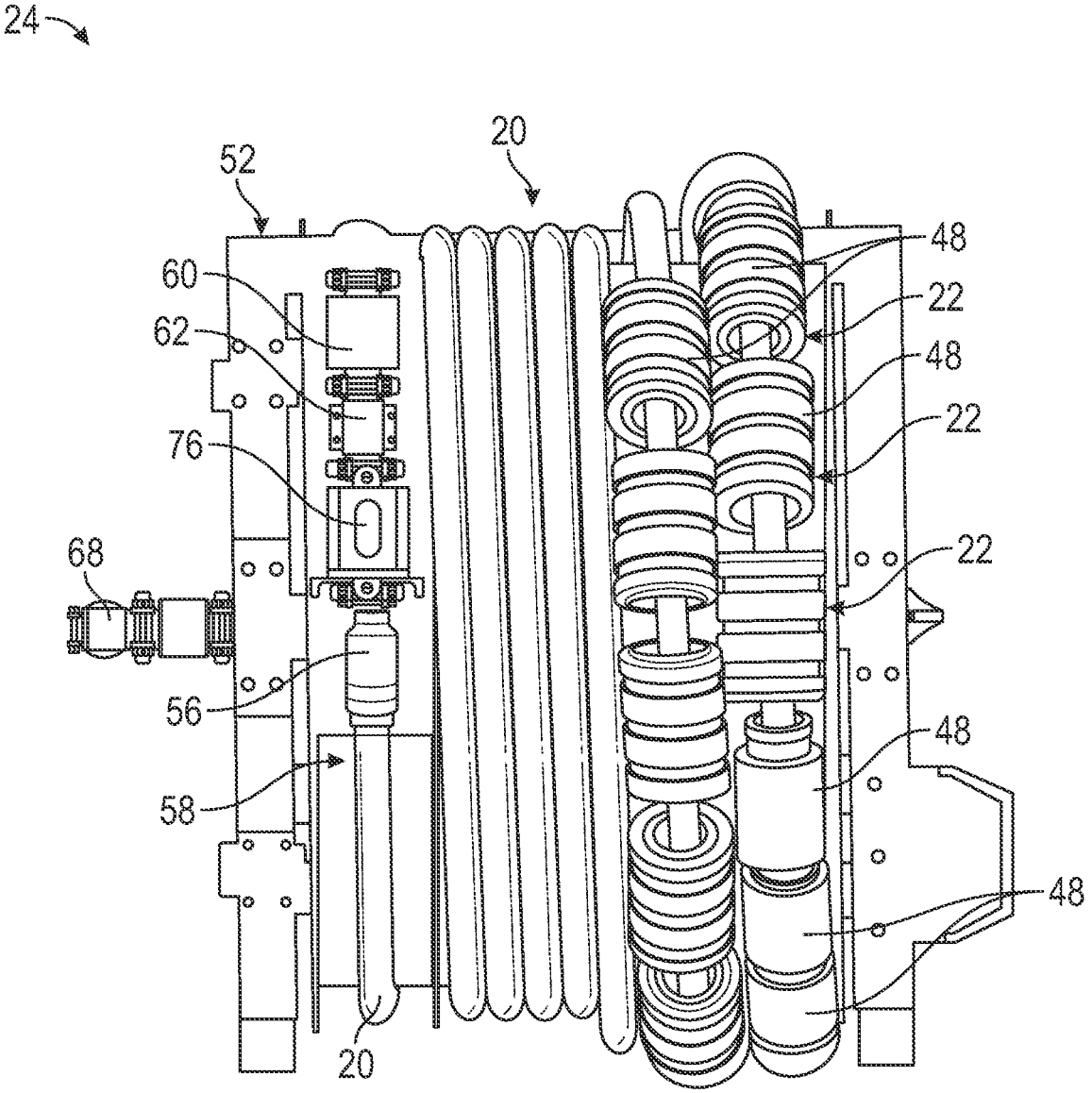
FIG. 14 illustrates another view of the winch including the mechanical intervention device launcher assembly, in accordance with embodiments of the present disclosure.
Figure 15:
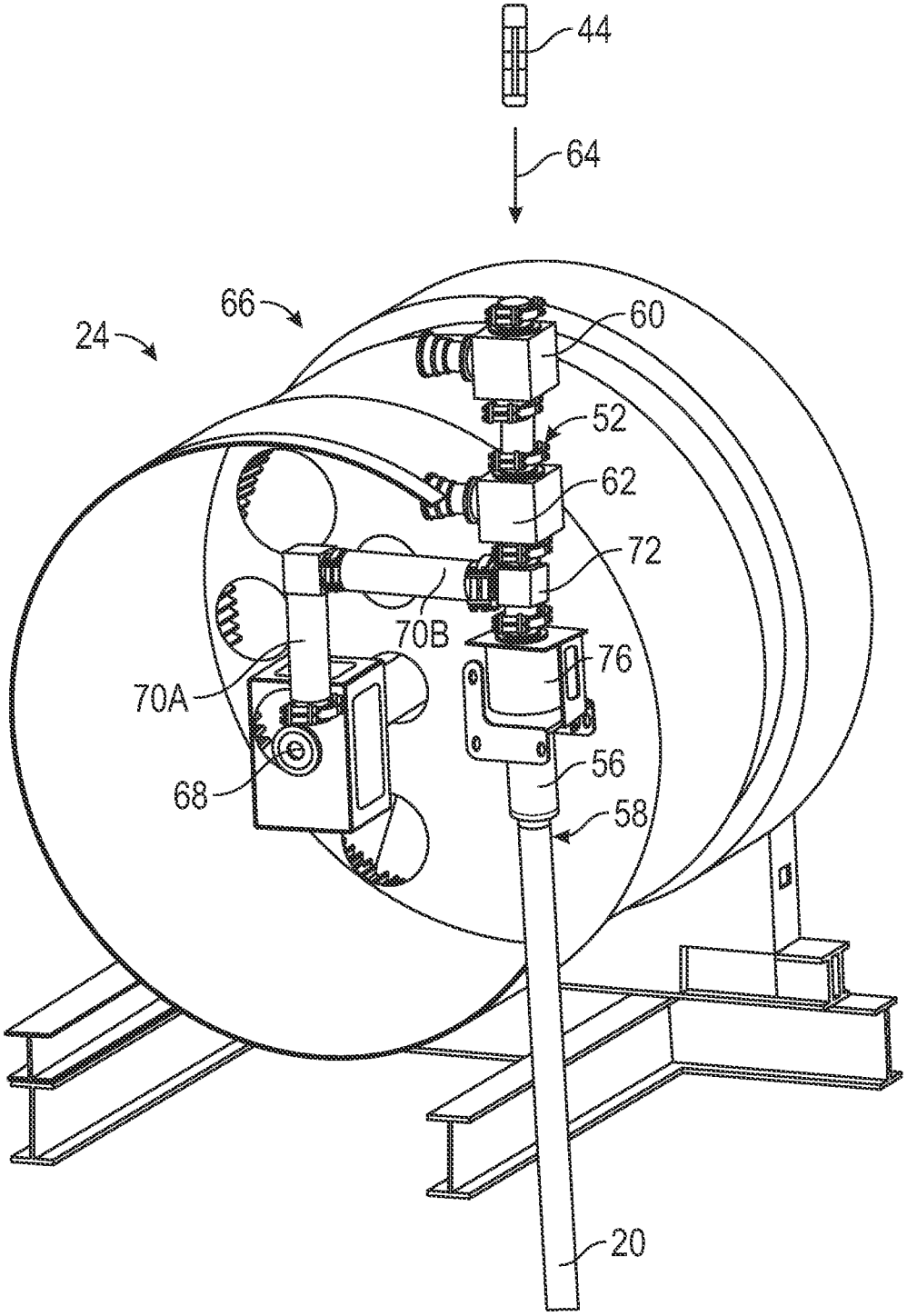
FIG. 15 illustrates another view of the winch including the mechanical intervention device launcher assembly, in accordance with embodiments of the present disclosure.
Figure 16:
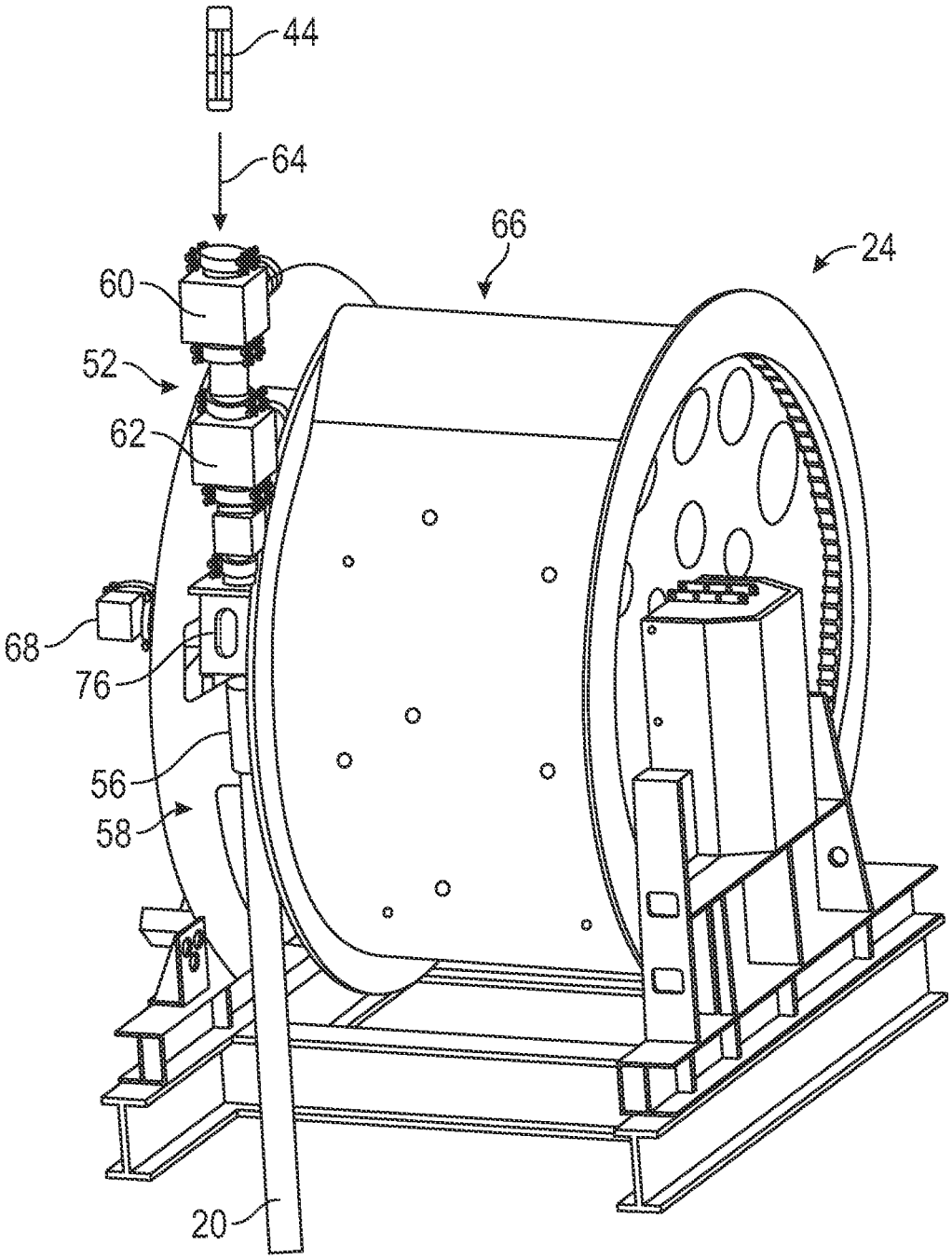
FIG. 16 illustrates another view of the winch including the mechanical intervention device launcher assembly, in accordance with embodiments of the present disclosure.

In certain embodiments, the winch 24 may include a mechanical intervention device launcher assembly 52 configured to facilitate the introduction of elongate, cylindrical mechanical intervention devices 44 into an intervention flow path. FIGS. 12 through 16 illustrate various views of embodiments of a winch 24 that includes a mechanical intervention device launcher assembly 52. In particular, FIGS. 12 through 14 are views of embodiments of the winch 24 with the hose 20 in a reeled/spooled position, and FIGS. 15 and 16 are views of embodiments of the winch 24 with the hose 20 in a deployed or unspooled position. As illustrated in FIGS. 12 through 14, the buoyancy modules 22 and bend restrictors 48 may be pre-installed around the hose 20 before the hose 20 is deployed. In some embodiments, bend restrictors 48 are incorporated into buoyancy modules 22 as described above. However, other embodiments of bend restrictors 48 involve constructing the bend restrictors 48 as separate devices relative to buoyancy modules 22 while similarly limiting bending of hose 20 (see, for example, FIG. 14). Some embodiments may have a combination of separate bend restrictors 48 and also integrated buoyancy modules 22/bend restrictors 48.

As illustrated, the mechanical intervention device launcher assembly 52 is coupled to a hose connector 56 at an upstream end 58 of the hose 20. In certain embodiments, the mechanical intervention device launcher assembly 52 includes a first valve 60 and a second valve 62 which may each be aligned axially with the end 58 of the hose 20 to facilitate insertion of a mechanical intervention device 44 when the hose 20 is in, for example, a fully deployed position (e.g., entirely unspooled from the spool 66 of the winch 24). Insertion of one of the mechanical intervention devices 44 is illustrated by arrow 64 in FIGS. 15 and 16. In some embodiments, the winch 24 may include a fluid inlet 68, e.g. a central fluid inlet, configured to receive fluid, and one or more conduits (e.g., pipes) 70 configured to deliver fluid from fluid inlet 68 and into the hose 20. Conduits 70 are illustrated as including a first conduit 70A that extends generally parallel to an axis of the hose 20 at the end 58 of the hose 20, and a second conduit 70B that extends generally perpendicular to the axis of the hose 20 at the end 58 of the hose 20 such that the first and second conduits 70A, 70B form a generally 90 degree angle with each other. However, different configurations of conduits 70 may be used. In certain embodiments, the conduits 70 deliver the fluid from the central fluid inlet 68 into the hose 20 at a location 72 between the first and second valves 60, 62 of the mechanical intervention device launcher assembly 52.

As illustrated most clearly in FIGS. 12 and 13, one or both of the first and second valves 60, 62 may be configured to shift between first and second positions, as shown via arrows 74 in FIG. 13. The first position enables insertion of a mechanical intervention device 44 and the second position blocks insertion of the mechanical intervention device 44. This opening and closing of the valves 60, 62 facilitates controlled insertion of each mechanical intervention device 44 into the hose 20. In the second position, the valves 60, 62 may be used to block insertion of a device 44 and also to block the flow of the fluid through the respective valves 60, 62. In certain embodiments, the first and second valves 60, 62 may be configured to be actively actuated (e.g., actuated based on command signals created by an operator of the winch 24).

Figure 17:
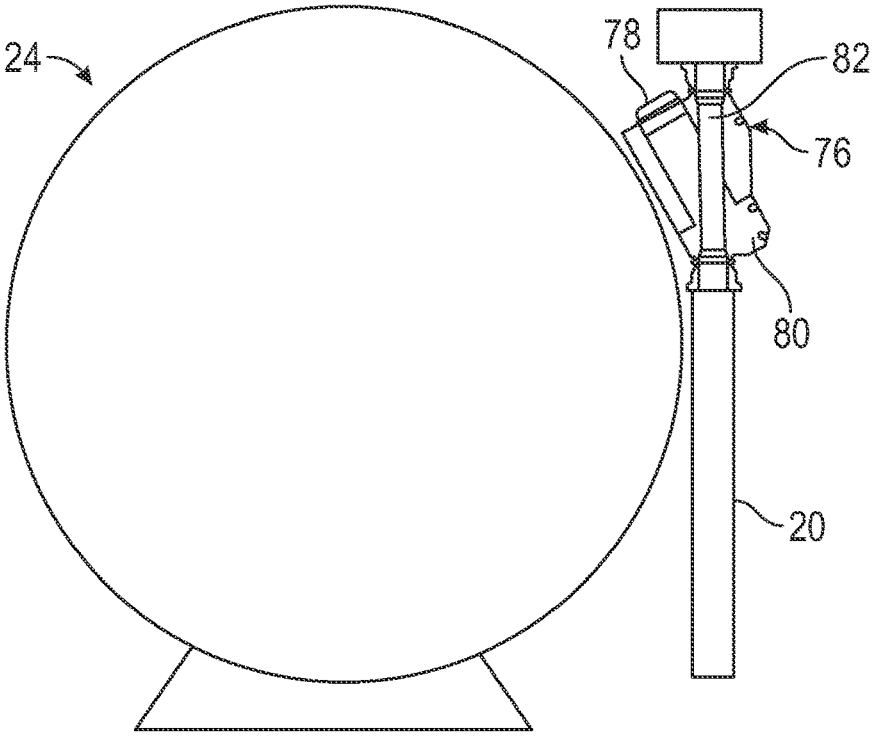
FIG. 17 illustrates a view of an emergency quick disconnect (EQD) device, in accordance with embodiments of the present disclosure.
Figure 18:
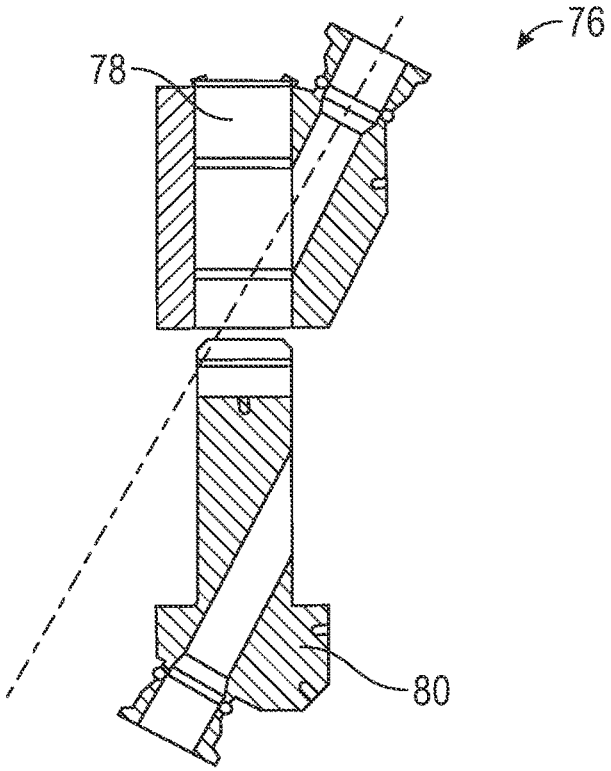
FIG. 18 illustrates another view of the emergency quick disconnect (EQD) device, in accordance with embodiments of the present disclosure.

According to an embodiment, as illustrated most clearly in FIGS. 14 through 16, the mechanical intervention device launcher assembly 52 also may include an emergency quick disconnect (EQD) device 76 configured to passively (e.g., without operator intervention) disconnect the fluid path through the mechanical intervention device launcher assembly 52 based on, for example, certain operating conditions such as increased pressure, temperature of the fluid, and/or vessel drift off. As such, the EQD device 76 functions as a passive breakaway system for the mechanical intervention device launcher assembly 52. FIGS. 17 and 18 illustrate different views of embodiments of the EQD device 76. In some embodiments, the EQD device 76 includes first and second body portions 78, 80 that, when coupled together, form an internal flow passage 82, which may be broken when the two body portions 78, 80 split apart, as illustrated in FIG. 18. By way of example, the body portions may be connected via a shear member, e.g. one or more shear pins, or other suitable quick disconnect device. EQDs of the general type illustrated are available from Secc Oil & Gas Ltd, located in Northwich Cheshire, UK. It also should be noted the EQD device 76 also may be constructed as an active disconnect, e.g. a dual active disconnect, to enable selectively control disconnection.

In certain embodiments, the sequence of launching a mechanical intervention device 44 using the mechanical intervention device launcher assembly 52 of the winch 24 may include initially deploying the hose 20 subsea and orienting the valves 60, 62 and the EQD device 76 such that the axis of the mechanical intervention device launcher assembly 52 is generally horizontal, as illustrated in FIGS. 12 and 13. The valves 60, 62 and the EQD device 76 are then axially aligned with the axis of hose 20 to enable connection with hose 20. The winch 24 may then be operated to rotate spool 66 so that the axis of the mechanical intervention device launcher assembly 52 is generally vertical. Valves 60, 62 may then be opened to drop the mechanical intervention device 44 into the mechanical intervention device launcher assembly 52. (It should be noted that in some embodiments the hose 20 may be connected when the axis of assembly 52 is generally vertical.)

According to an embodiment, valves 60 and 62 may be sequentially opened and closed to facilitate insertion of mechanical intervention device 44 while maintaining a barrier to the well. During initial insertion of each device 44, for example, one or more valves of the subsea tree 18 and one of the valves 60, 62 (e.g. valve 62) may be closed to provide two barriers to the well, while leaving the other valve 60, 62 (e.g. valve 60) open for receiving device 44. Subsequently, valves 60, 62 may be manipulated to enable movement of the device 44 to the well while maintaining well isolation. An example of manipulating valves 60, 62 includes closing valve 60 and then opening valve 62 to enable movement of the mechanical intervention device 44 into hose 20. The subsequent opening of the valves on the subsea tree 18 and the movement of mechanical intervention device 44 down through hose 20 enables deployment of the device 44 into the well. In some embodiments, the winch 24 may be spooled back a relatively small amount (e.g., between 10-15 feet, for example) to facilitate loading of each successive mechanical intervention device 44.

The embodiments described herein improve operational efficiency of subsea hydraulic interventions which involve the introduction of mechanical intervention devices 44 into the intervention flow path. Reduced operational time, and thus operating expense, is achieved as the deployment or retrieval of the subsea connector (e.g., the fluid injection assembly 30 described herein) and the hose 20 is executed in a single step, and there is no need for the hose 20 to be disconnected from the subsea tree 18 to complete the well with multi-stimulation treatments. That is, the embodiments described herein facilitate the introduction of multiple mechanical intervention devices 44 into the intervention flow path, for zonal isolation between each hydraulic intervention stage, without disconnecting the hose 20 from the subsea tree 18. As the winch 24 may have the hose 20, the buoyancy module(s) 22, and the bend restrictor(s) preconfigured onshore, reduced manual handling is required offshore on the vessel 12, thus substantially improving operation of the subsea well intervention system 10. In addition, the dual active and single passive emergency disconnect system also provides significant risk mitigations to vessel drift-off or drive-off scenarios. In some operations, the powered winch 24 may be an electrically powered winch selected to provide a more reliable and a lower carbon footprint system compared to other winches.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A subsea hose deployment winch, comprising:

a spool configured to have a subsea hose spooled thereon; and a mechanical intervention device launcher assembly configured to be directly coupled to an end of the subsea hose, wherein the mechanical intervention device launcher assembly is configured to facilitate insertion of a mechanical intervention device into the subsea hose while maintaining an isolation barrier to the environment, and wherein the mechanical intervention device launcher assembly comprises an emergency quick disconnect (EQD) device aligned axially with the end of the subsea hose when the mechanical intervention device launcher assembly is directly coupled to the subsea hose, wherein the EQD device is configured to passively disconnect a fluid path through the mechanical intervention device launcher assembly.

2. The subsea hose deployment winch of claim 1, wherein the mechanical intervention device launcher assembly comprises one or more valves, each valve being aligned axially with the end of the subsea hose when the mechanical intervention device launcher assembly is directly coupled to the subsea hose, and wherein each valve is configured to facilitate the insertion of the mechanical intervention device into the subsea hose.

3. The subsea hose deployment winch of claim 2, wherein the one or more valves are configured to shift between first and second positions, wherein the first position enables the insertion of the mechanical intervention device into the subsea hose and the second position blocks the insertion of the mechanical intervention device into the subsea hose.

4. The subsea hose deployment winch of claim 3, wherein the second position blocks the flow of fluid through the respective valve.

5. The subsea hose deployment winch of claim 2, wherein the one or more valves are configured to be sequentially actuated.

6. The subsea hose deployment winch of claim 1, wherein the EQD device comprises first and second body portions that form an internal flow passage that defines the fluid path when the first and second body portions are coupled together.

7. The subsea hose deployment winch of claim 1, further comprising one or more conduits oriented to provide a fluid path between a central fluid inlet of the subsea hose deployment winch and the subsea hose.

8. The subsea hose deployment winch of claim 1, wherein the mechanical intervention device launcher assembly is configured to be rotated to further facilitate the insertion of the mechanical intervention device into the subsea hose.

9. A system, comprising:

a spool having a subsea hose spooled thereon;

a mechanical intervention device launcher assembly configured to be directly coupled to an end of the subsea hose, wherein the mechanical intervention device launcher assembly is configured to facilitate insertion of a mechanical intervention device into the subsea hose while maintaining an isolation barrier to the environment; and a plurality of buoyancy modules pre-installed around the subsea hose.

10. The system of claim 9, further comprising a plurality of bend restrictors pre-installed around the subsea hose.

11. The system of claim 10, wherein the plurality of bend restrictors are integrally combined with the plurality of buoyancy modules.

12. The system of claim 10, wherein the spool is electrically powered.

13. The system of claim 10, wherein the spool is hydraulically powered.

14. The system of claim 10, further comprising an emergency quick disconnect positioned to enable interruption of a fluid path through the mechanical intervention device launcher assembly.

15. The system of claim 10, further comprising the mechanical intervention device in the form of an elongate, cylindrical mechanical intervention dart.

16. The system of claim 10, further comprising the mechanical intervention device, the mechanical intervention device having a length-to-diameter ratio of greater than 3.0.

* * * * *